US009085952B2

(12) United States Patent
Rondeau et al.

(10) Patent No.: US 9,085,952 B2
(45) Date of Patent: Jul. 21, 2015

(54) APPARATUS AND METHOD FOR LAUNCHING PLUGS IN CEMENTING OPERATIONS

(75) Inventors: Joel Rondeau, Antony (FR); André Salvaire, Singapore (SG)

(73) Assignee: Schlumberger Technology Corporation, Sugar Land, TX (US)

( * ) Notice: Subject to any disclaimer, the term of this patent is extended or adjusted under 35 U.S.C. 154(b) by 1006 days.

(21) Appl. No.: 13/130,852

(22) PCT Filed: Nov. 24, 2009

(86) PCT No.: PCT/EP2009/008426

§ 371 (c)(1),
(2), (4) Date: Aug. 16, 2011

(87) PCT Pub. No.: WO2010/066341

PCT Pub. Date: Jun. 17, 2010

(65) Prior Publication Data

US 2011/0290481 A1 Dec. 1, 2011

(30) Foreign Application Priority Data

Dec. 10, 2008 (EP) ..... 08171171

(51) Int. Cl.

| | |
|---|---|
| ***E21B 33/13*** | (2006.01) |
| ***E21B 33/05*** | (2006.01) |
| ***E21B 23/00*** | (2006.01) |
| ***E21B 23/04*** | (2006.01) |

(52) U.S. Cl.
CPC ..... *E21B 33/05* (2013.01); *E21B 23/00* (2013.01); *E21B 23/04* (2013.01)

(58) Field of Classification Search
CPC ..... E21B 33/12; E21B 33/14; E21B 33/146; E21B 33/16; E21B 33/134; E21B 33/136
USPC ..... 166/250.04, 289, 291, 373, 101, 179, 166/118, 121, 125, 134, 135, 138, 192, 153, 166/156, 320
See application file for complete search history.

(56) References Cited

U.S. PATENT DOCUMENTS

| | | | | |
|---|---|---|---|---|
| 2,344,120 | A * | 3/1944 | Baker | 166/289 |
| 4,907,649 | A * | 3/1990 | Bode | 166/70 |
| 5,146,992 | A | 9/1992 | Baugh | |
| 5,797,454 | A | 8/1998 | Hipp | |
| 5,890,537 | A | 4/1999 | Lavaure et al. | |
| 2004/0035586 | A1 | 2/2004 | Gudmestad et al. | |

* cited by examiner

*Primary Examiner* — Cathleen Hutchins
*Assistant Examiner* — Ronald Runyan
(74) *Attorney, Agent, or Firm* — Jeremy D. Tillman; Rachel E. Greene; Tim Curington

(57) ABSTRACT

An apparatus for use in launching cement plugs in a well cementing operation, comprising: a cylinder (130); a piston (110) slideably received in the bore of the cylinder; and an actuator, operable by the piston, for launching a plug from the apparatus into the well; wherein the cylinder has a resiliently mounted latching member (132) positioned in the wall thereof and biased to project into the bore of the cylinder; and the piston has a profiled outer surface defining a recess (114) into which the latching member (132) can project to hold the piston in position in the cylinder.

15 Claims, 11 Drawing Sheets

APPARATUS AND METHOD FOR LAUNCHING PLUGS IN CEMENTING OPERATIONS

TECHNICAL FIELD

This invention relates to apparatus and methods for launching plugs in cementing operations of the type found when constructing wells in the oil and gas industry. In particular, the invention relates to the use of a latching mechanism for controlling the movement of a piston in a plug launcher.

BACKGROUND ART

In the construction of oil and gas wells, it is occasionally necessary to cement a liner or casing in the well to provide stability and zonal isolation. In such processes, it is common to use plugs to separate different fluids pumped along the tubing or casing. Such plugs are usually installed in a basket located in cementing equipment lowered into the well. The plugs are launched from the basket by means of darts pumped from the surface.

A known cement plug launching tool (see U.S. Pat. No. 5,890,537) is shown in FIGS. 1-3. The body 32 of the launching tool includes an upper tubular housing 40 whose upper end is threaded to the mandrel of the liner setting tool, and whose lower end is threaded at 41 to a spacer tube 42. A sleeve valve 44 which is slidable in the bore of the housing 40 is biased upward to a normally open position with respect to ports 38 by a coil spring 46.

A piston 50 connected to a drive rod 36 slides in the bore of the spacer tube 42 which is connected to the upper end of a cylinder tube 55. An lower piston 58 is formed on the rod 36 and slides within the bore 60 of the cylinder tube 55 which is filled with a suitable hydraulic oil. The piston 58 has an outer diameter that provides a selected clearance with respect to the wall of the bore 60 such that, as the piston is forced downward with the rod 36, a metering effect is created which retards the rate of downward movement.

The lower end of the cylinder tube 55 is connected to the upper end of the basket 33 which initially houses the upper and lower wiper plugs 34, 35, and is provided with a plurality of longitudinal slots 68 that receive radial stop pins 70 which extend from the outer periphery of a drive flange 75 that rests on top of the upper plug 34. A head 71 on the upper end of the upper plug 34 receives the inner ends of several radially extending shear pins 73 on the drive flange 75 to releasably couple the plug 34 to the flange.

In operation and use, the liner is run and suspended by a hanger from a point near the lower end of the casing which is below the wellhead. The plug launcher tool is connected to the lower end of the mandrel, and the wiper plugs 34 and 35 were previously loaded into the basket 33. The drive rod 36 is in its upper position where the piston 58 is at the upper end of the oil chamber 60. The ports 38 in the housing 40 are open so that fluids can flow therethrough. A dart launcher is provided at the surface.

In order to cement the liner in place, cement slurry is pumped in through the dart launcher, and then a valve is opened to release a lower dart 101. Pressure is applied to the top of the dart 101 to force it through the valve and down into the drill pipe ahead of the cement. Eventually the dart 101 enters the housing 40, passes into the bore of the valve sleeve 44, and to a position where its nose bumps against the drive head 50 of the rod 36. Since the elastomer cups of the dart 101 seal off the bore of the valve sleeve 44, pressure causes the sleeve valve to shift downward against the bias of the coil spring 46, and in so doing, partially close off the radial ports 38.

Pressure on the dart 101 applies downward force to the rod 36 and causes it to shift downward in the body 32, thereby driving both the upper and lower wiper plugs 34 and 35 downward. Such movement is slowed by the action of hydraulic oil that meters upward through the clearance between the piston 58 and the inner wall of the cylinder 60 so that shock loads are dissipated. When the pins 70 on the drive plate 75 reach the bottoms of the slots 68 as shown in FIG. 2, downward movement of the upper plug 34 is stopped. However the lower plug 35 will have been ejected from the bottom of the basket 33 and into the bore of the liner. At about the same time as the stop pins 70 encounter the bottoms of the slots 68, the top cup of the dart 101 clears the bottom of the sleeve valve 44 so that the ports 38 are re-opened as the sleeve valve is shifted upward by the coil spring 46. Pumping of cement is continued until the desired number of barrels of cement has been placed within the liner.

When the proper amount of cement has been pumped into the running string, the upper dart 100 is forced into the drill pipe, followed by whatever fluid is being pumped behind it. The dart 100 travels down through the running string, the mandrel, and into the housing 40. When the cups of the dart 100 enter the valve sleeve 44 and seal off its bore, the valve sleeve shifts downward to close off the lateral ports 38. The dart 100 then engages the lower dart 101, so that applied pressures force the drive rod 36 further down in the body 32 as shown in FIG. 3. The pins 73 are sheared so that the drive disc 66 on the lower end of the rod 32 passes through the plate 75 and forces ejection of the upper wiper plug 34 from the bottom of the basket 33. The metering of oil past the piston 58 again slows or retards downward movement of the rod 32 so that ejection is smoothed. When the top end of the dart 100 clears the bore of the valve sleeve 44, the valve sleeve again opens, as before, so that displacement fluids flow around the outside of the launcher assembly and through the annular space between the basket 33 and the inner wall of the liner. A positive indication of the launching of wipers plugs 34 and 35 from basket 33 is shown by an increase in pumping pressure at the surface location resulting from the cushioned travel of piston 58 for both plugs 34 and 35. The shearing of pins 73 for upper plug 34 additionally increases the pumping pressure for upper plug 34. For example, the increase in the pumping pressure may amount to about 1500 psi for lower plug 35 and to about 3000 psi for upper plug 34.

As is discussed above, the most common method of latching components inside a pipe is to use shear pins, shear screws or the like. A known force is applied to the shearing component, which subsequently fails mechanically and releases the downhole component that had been latched inside the pipe. Such a system causes debris from the broken shearing components to remain inside the pipe and also requires that the shearing components be replaced after each use. The downhole components, once unlatched, can not be re-secured inside the pipe until it has been recovered back to the surface.

It is an object of the invention that allows the latching of a piston in a plug launching system without the need for shear pins to be used. The invention is based on the use of resiliently biased latching members.

DISCLOSURE OF THE INVENTION

A first aspect of the invention provides an apparatus for use in launching cement plugs in a well cementing operation, comprising:

- a cylinder;
- a piston slideably received in the bore of the cylinder; and
- an actuator, operable by the piston, for launching a plug from the apparatus into the well;

wherein the cylinder has a resiliently mounted latching member positioned in the wall thereof and biased to project into the bore of the cylinder; and the piston has a profiled outer surface defining a recess into which the latching member can project to hold the piston in position in the cylinder.

The profile in the outer surface of the piston preferably comprises angled surfaces to allow the piston to engage the latching member to progressively move it out of the bore of the cylinder and the piston is moved past the latching member. The profile typically comprises first and second angled surfaces on opposite sides of the recess.

The angled surfaces can be arranged such that the force required to move the piston so that the latching member passes over the first surface and engages in the recess reaches a first maximum, and the force required to move the piston so that the latching member disengages from the recess and passes over the second surface reaches a second maximum.

Preferably, the first and second surfaces have different profiles such that the first and second maxima are different. The second maximum is typically greater than the first.

Multiple latching members can be provided around the cylinder bore.

The latching member preferably comprises spring dogs attached at one end to the cylinder and including a locking formation defined at the other, free end for engagement in the recess.

A second aspect of the invention provides a method of launching a plug in a well cementing operation using an apparatus as claimed in any preceding claim, the method comprising:

initially forcing the piston along the bore of the cylinder until the latching member engages in the recess; and subsequently forcing the piston further along the bore of the cylinder so as to detach the latching member from the recess; wherein movement of the piston is transferred to the plug by means of the actuator.

An increasing force, provided by the latching members, slows the movement of the piston down before the latching members engage in the recess of the piston, bringing it to a hard stop.

The step of forcing the piston along the bore of the cylinder preferably comprises pumping a dart along a pipe connected to the cylinder until the dart contacts the piston, and applying fluid pressure above the dart to move the dart and piston along the cylinder bore.

In this case, the step of initially forcing the piston along the cylinder bore can comprise pumping a first dart into contact with the piston, and the step of subsequently forcing the piston along the cylinder bore can comprise pumping a second dart into contact with the first dart.

The method preferably comprises measuring the pressure of the fluid used to move the darts and detecting a first pressure maximum indicative of engagement of movement of the latching member in the recess, and detecting a second maximum indicative of detachment of the latching member from the recess.

Further aspects of the invention will be apparent from the following description.

MODE(S) FOR CARRYING OUT THE INVENTION

Figure 1:
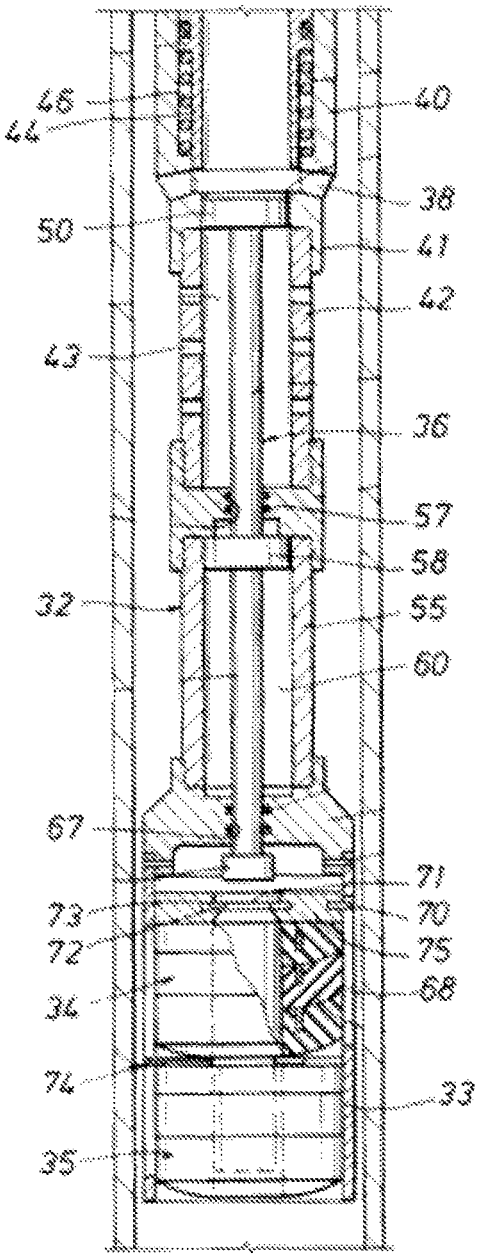
Figure 1 PRIOR ART
FIGS. 1-3 show the operation of a prior art system.
Figure 2:
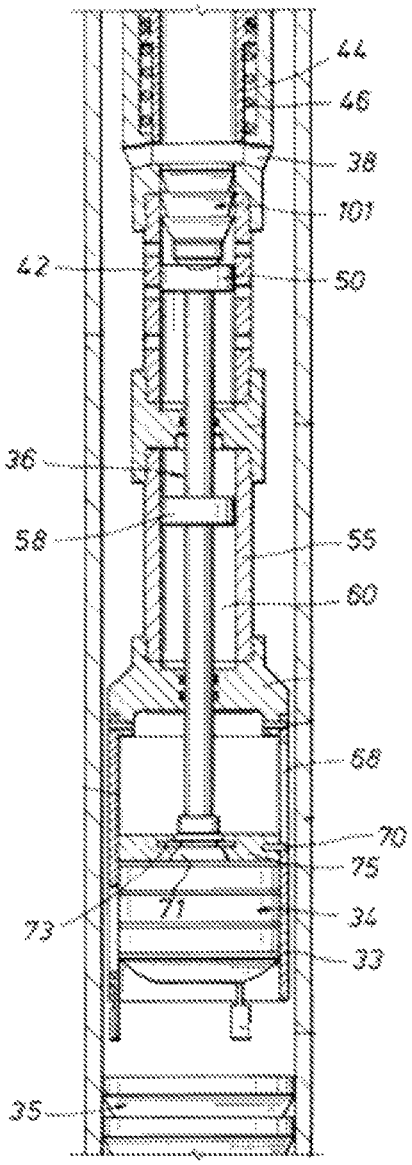
Figure 2 PRIOR ART
Figure 3:
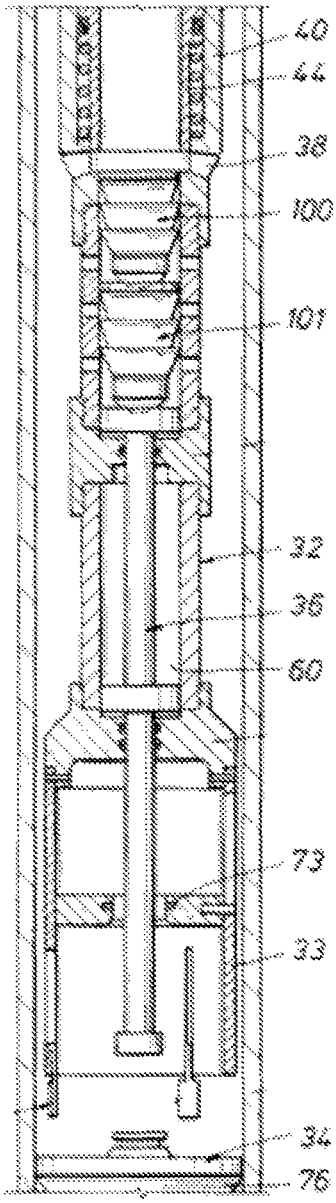
Figure 3 PRIOR ART

This invention provides a piston system that replaces that shown in FIGS. 1-3 discussed above. In particular, the piston and cylinder arrangement 58, 60, and the shear pin and slots 68, 70 of FIGS. 1-3 are replaced by the system described below.

The apparatus and its operation are shown in FIGS. 4A-4F. The apparatus comprises three portions. The first portion comprises the following elements. A first plug 401 and a second plug 402 are located inside a plug basket 403. A plug piston 404, located above the plug basket 403, is driven by a main rod 405. A drive piston 406 is attached at the top of the main rod 405. The drive piston 406 and the upper portion of the main rod 405 are encased inside the bore of a cylinder 407. The cylinder 407 contains a latching mechanism that comprises at least two spring dogs 408 and 409. Above the drive piston 406, there are ports 410 and 411 through which wellbore service fluids may flow. This first portion of the apparatus is initially installed inside another tubular body 412. The tubular body may comprise casing. The second portion of the apparatus is a first dart 413. This second portion of the apparatus is initially separated from the first portion. The third portion of the apparatus is a second dart 414, and is also initially separated from the first portion.

Figure 5:
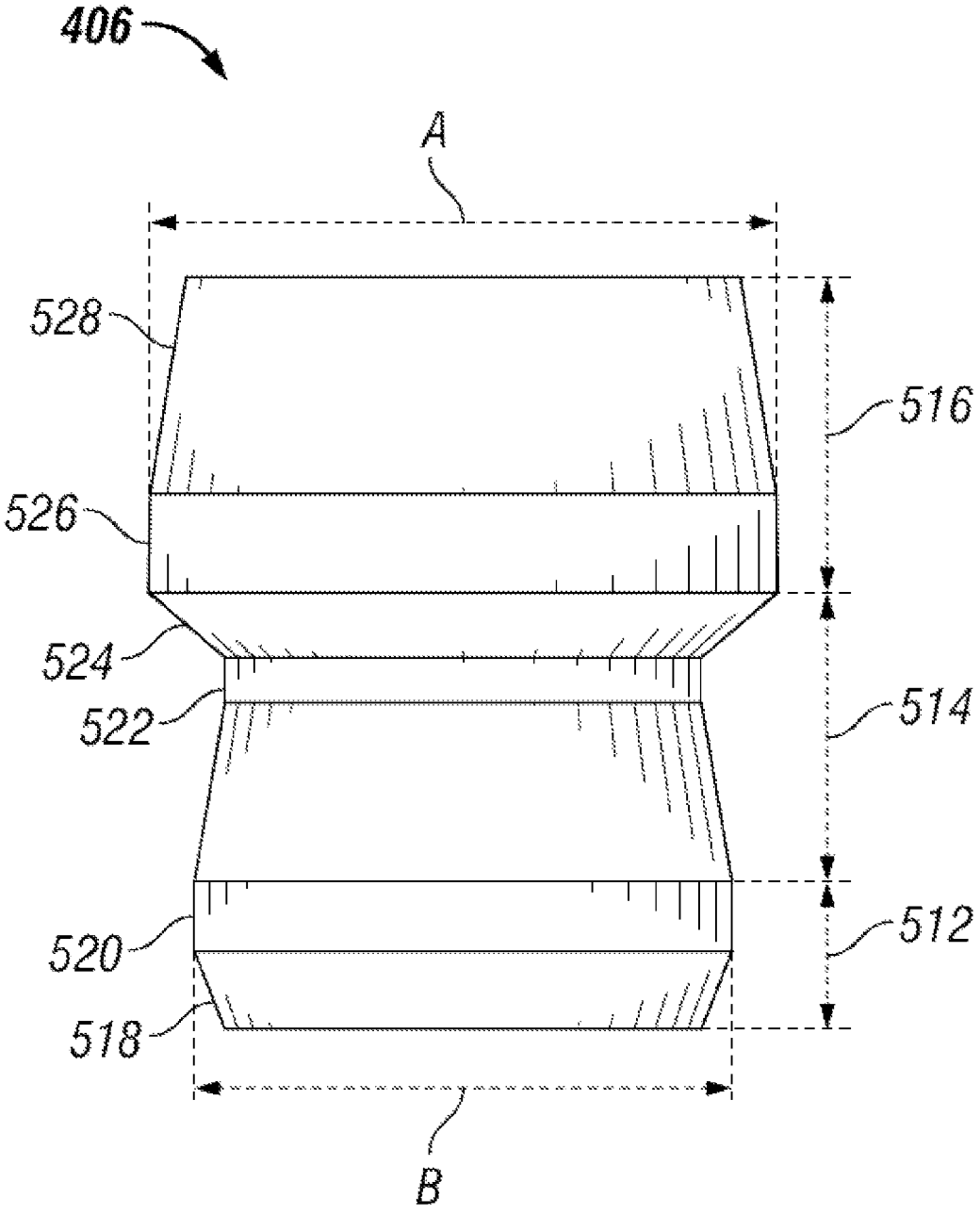
FIG. 5 is a detailed view of the drive piston of the disclosed apparatus.

A detailed view of the drive piston 406 is presented in FIG. 5. The drive piston 406 is attached to the main rod 405 (shown in FIG. 4A) that acts as an actuator to drive plugs from the basket 403 (shown in FIG. 4A). The drive piston 406 has a profiled outer surface comprising a bottom section 512, a recess 514 and a top section 516. The bottom section 512 comprises an angled surface 518 that flares from the bottom end of the piston to a first diameter surface 520 that has a first maximum diameter B less than that of the cylinder bore. The diameter of the plug then decreases behind the first diameter surface 520 to the base 522 of the recess 514. The top section 516 comprises a further angled surface 524 that flares from the base 522 of the recess 514 to a second diameter surface 526 having a second maximum diameter A that corresponds closely to the inner diameter of the cylinder bore. The second maximum diameter A is greater than the first maximum diameter B. The surface 528 then reduces somewhat to the top end of the piston that is adapted for contact with the first dart 413 (shown in FIG. 4A).

Figure 6:
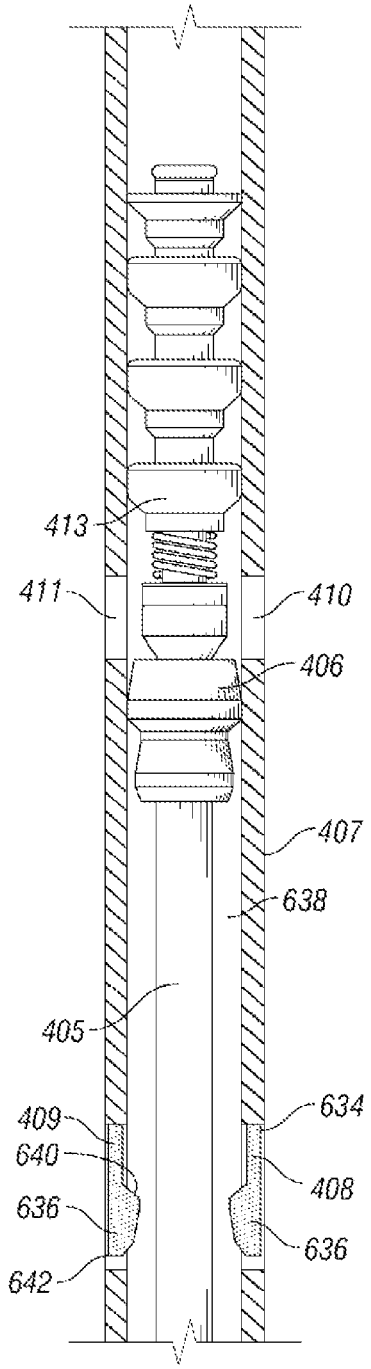
FIG. 6 shows the drive piston of FIG. 5 in the cylinder that forms part of the disclosed plug launching system.

FIG. 6 shows the drive piston 406 of FIG. 5 in the cylinder 407 that forms part of the plug launching system. The cylinder 407 includes a latching mechanism comprising a series of latching members disposed around its periphery. The latching members comprise spring dogs 408 and 409 which are connected to the cylinder 407 at one end 634 and have a latching portion 636 formed at the other which projects through a slot in the cylinder into the bore 638. The top edge 640 of the latching portion 636 is angled to and the lower edge 642 is curved away from the top edge 640. Thus, the top edge 640 serves as a locking formation for engagement in the recess 514 of the drive piston 406.

Figure 4A:
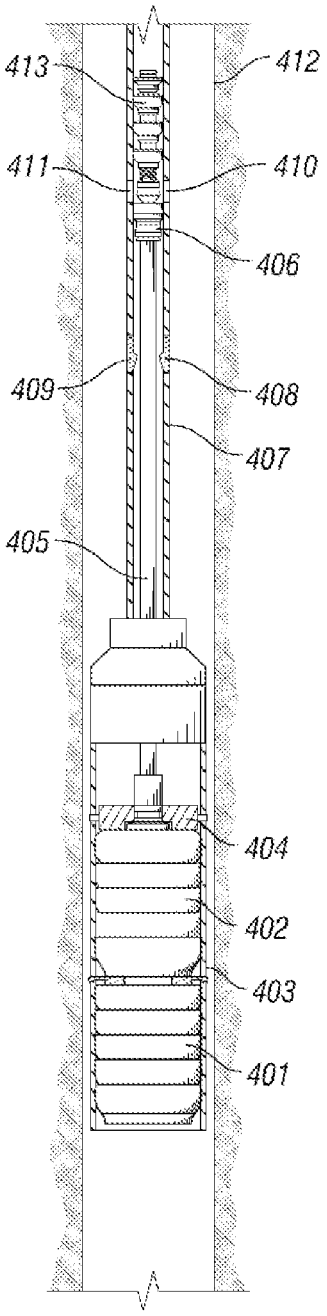
FIGS. 4A-4F show the disclosed apparatus and its operation.
Figure 4B:
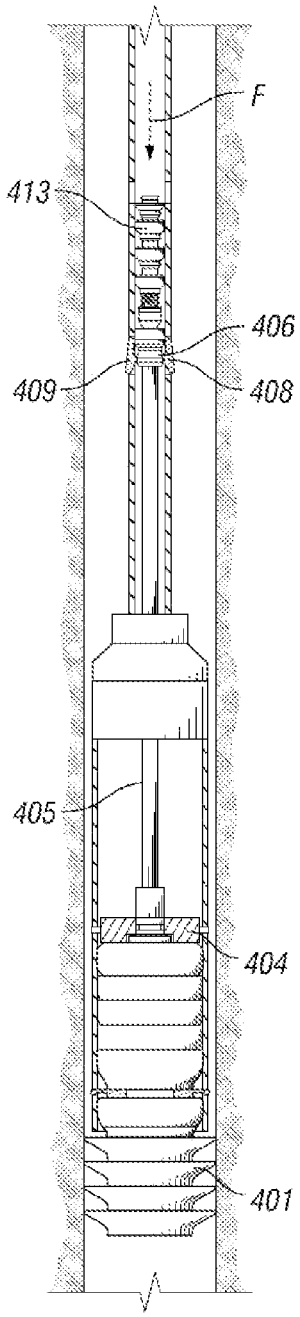
Figure 4C:
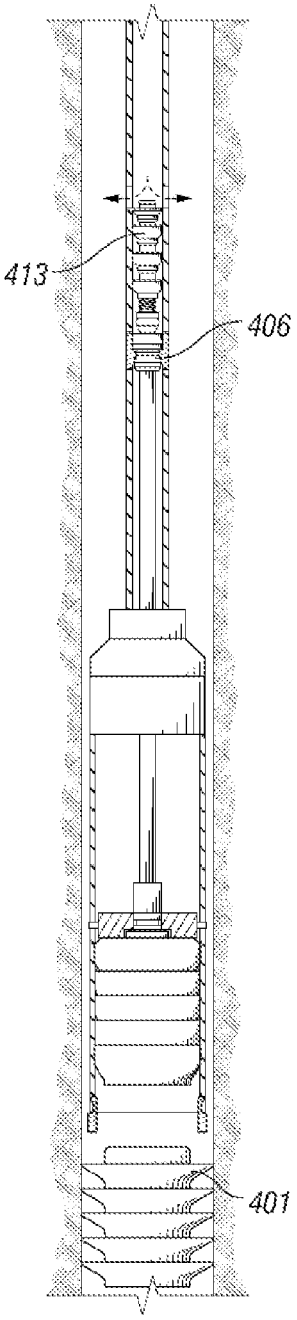
Figure 7:
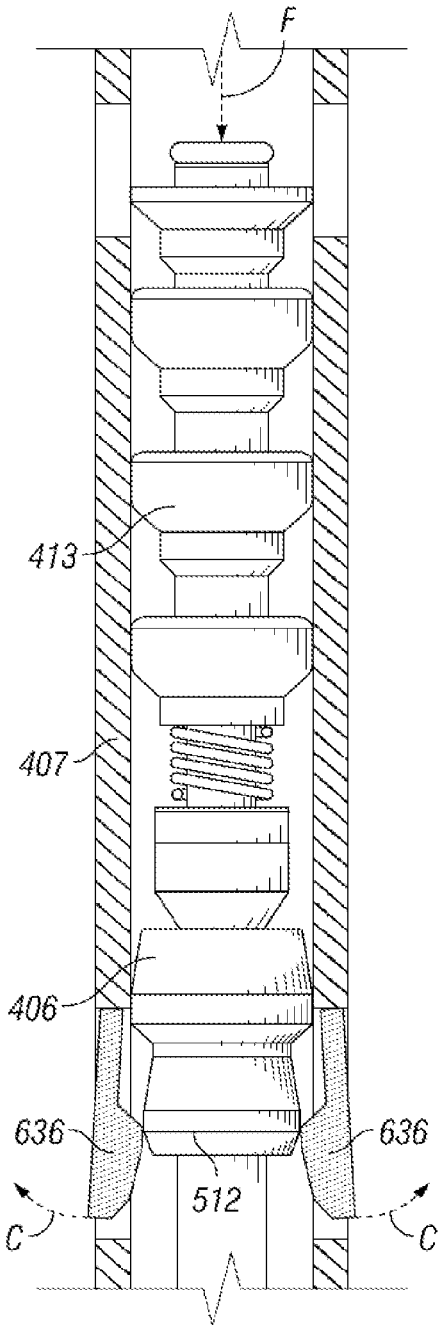
FIG. 7 depicts the moment during which angled surface of the bottom section of the drive piston engages the top edge of the latching portion of the disclosed plug launching system and causes the spring dogs to move outward.

In use, a first fluid is pumped into the tubular body 412. The first portion of the apparatus is placed inside the tubular body 412. The first dart 413 is pumped into the first portion of the apparatus in the usual manner to apply a force F to the drive piston 406 and force it along the cylinder 407 until the angled surface of the bottom section 512 engages the top edge of the latching portion 636 (FIG. 7 and FIG. 4B). The force applied to the piston (i.e., the pressure of the fluid used to pump it along the cylinder) is increased and the piston 406 continues to move, pushing the latching portions 636 of the spring dogs 408 and 409 outward C against the biasing effect of the spring dogs. As shown in FIG. 4B, the downward movement of the first dart 413 has caused the main rod 405 and plug piston 404 to also move downward and begin to expel the first plug 401.

Figure 8:
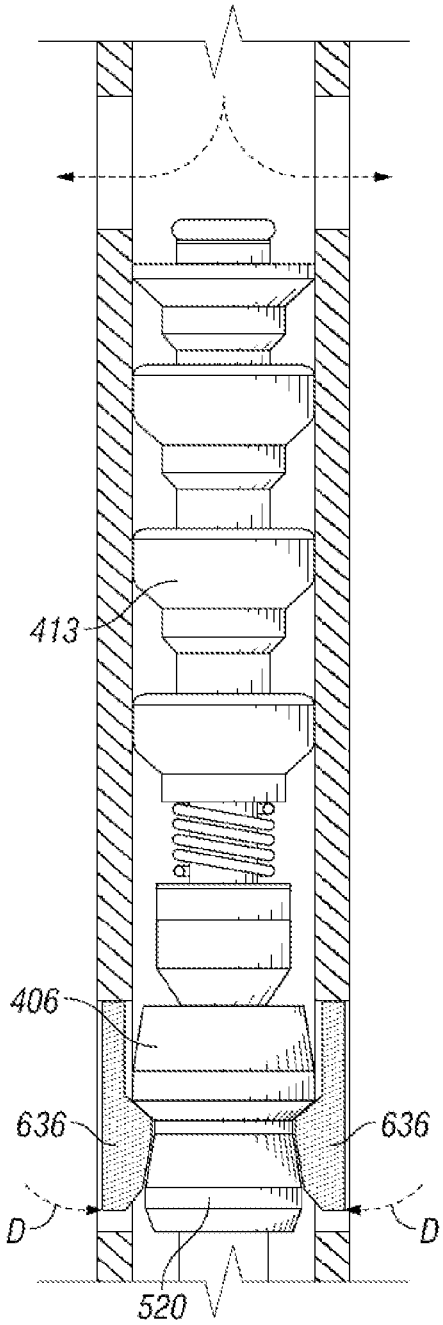
FIG. 8 depicts the moment at which the latching portion has passed over the first diameter surface of the drive piston, causing the spring dogs to move inwardly.

As the piston continues to move downward (FIG. 8), the latching portions 636 pass over the first diameter surface 520 and flex back inwardly D to engage in the recess 514 and bring the drive piston to a hard stop. At this point, the first plug 401 will have been ejected from the basket 403 (FIG. 4C) and the drive piston 406 will be held in place by the latching of the spring dogs 408 and 409 in the recess 514. Furthermore, the first dart 413 blocks the further passage of process fluid into the cylinder 407; consequently, process fluid flow is diverted through ports 410 and 411. A second fluid may be pumped behind the first plug 401.

Figure 4D:
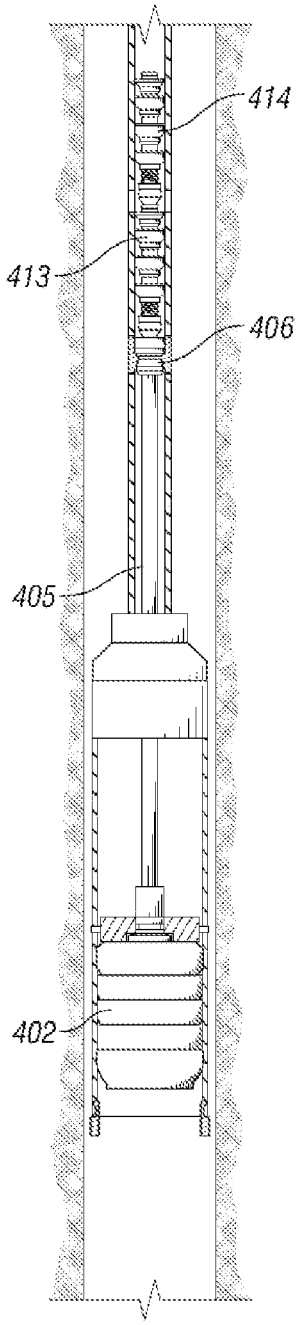
Figure 4E:
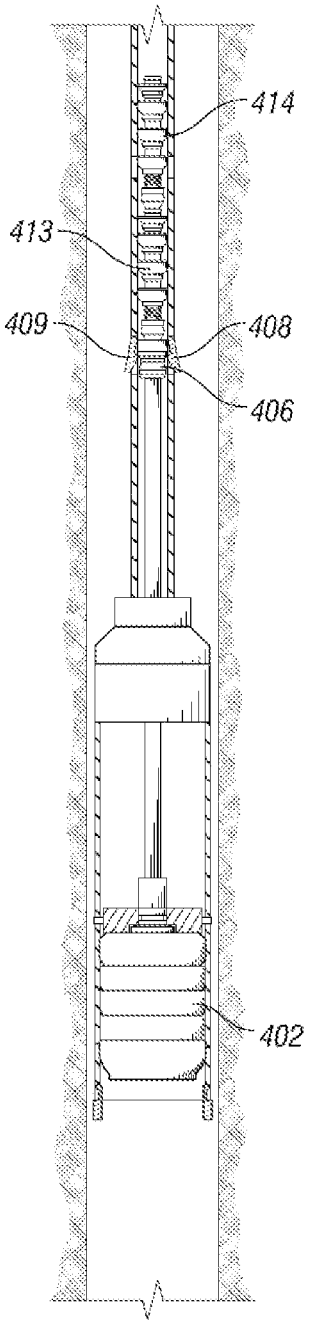
Figure 4F:
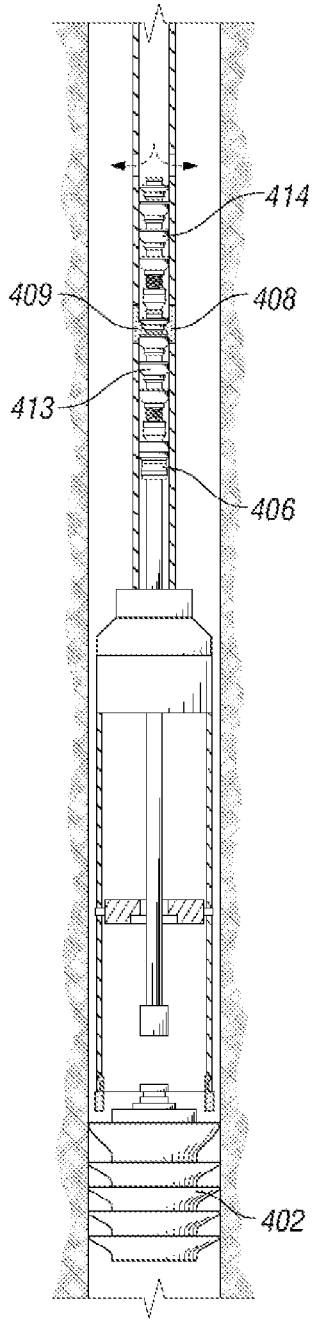
Figure 9:
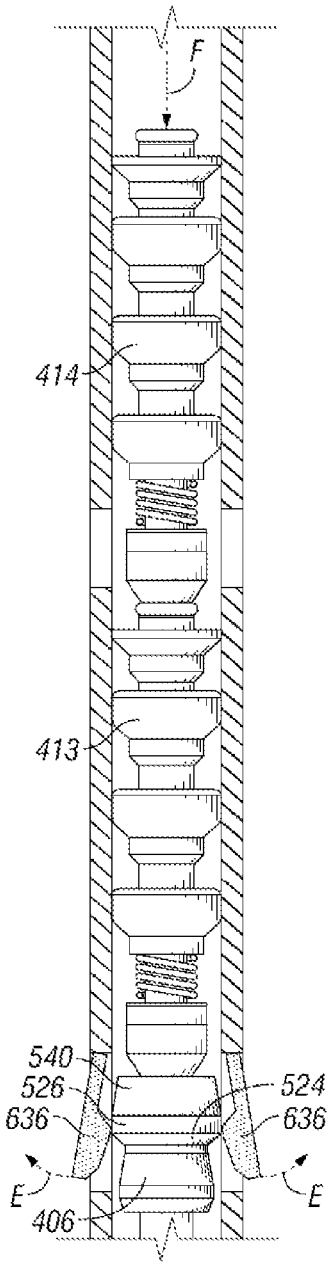
FIG. 9 depicts the arrival of the second dart, causing the drive piston to move further downward and cause the spring dogs to move outward.
Figure 10:
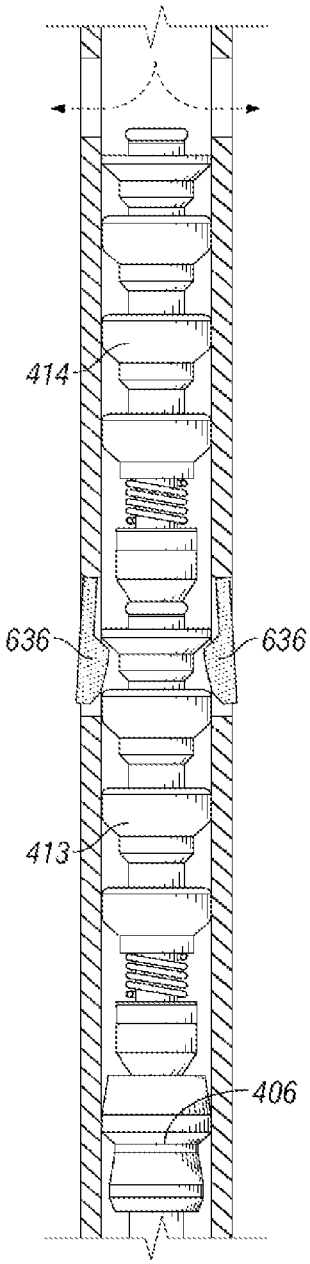
FIG. 10 depicts the moment at which the latching portion has passed over the second diameter surface of the drive piston, causing the spring dogs to move inwardly.

To eject the second plug, the second dart 414 is pumped from the surface to contact the top of the first dart (FIG. 4D and FIG. 9). The force F is increased until the drive piston 406 moves, the surface 524 acting on the top edge 540 of the latching portions 636 to force them outwards E until they pass over the second diameter surface 526, thereby releasing the drive piston 406 (FIG. 4E). As the second plug is ejected, the drive piston 406 moves down and away from the latching portions 636. Once the piston is fully past the spring dogs 408 and 409, the latching portions 636 are allowed to resume their initial positions (FIG. 10 and FIG. 4F). The second dart blocks the further passage of process fluid into the cylinder 407; consequently, process fluid flow diverted through ports 410 and 411.

Following use, the device can be reset by withdrawing the drive piston 406 from the bottom of the cylinder 407 and re-inserting it at the top, or by forcing the drive piston 406 back up the cylinder 407 past the spring dogs 408 and 409.

Figure 11:
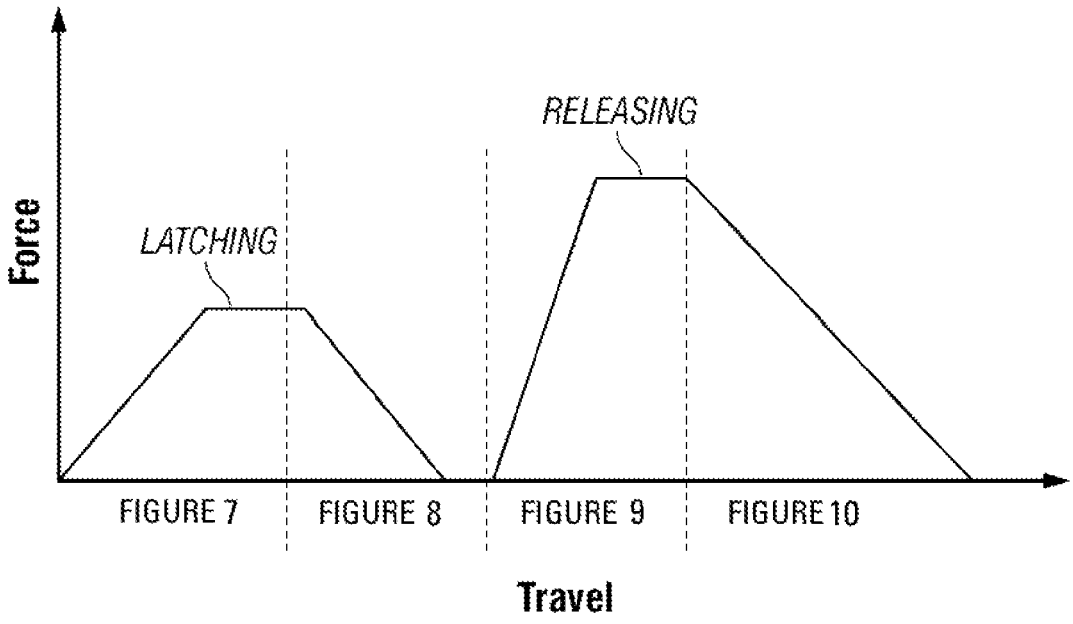
FIG. 11 is a graph that shows the force against distance traveled during latching and unlatching.

In order to monitor the progress of the plug launching operation, the pressure of the fluid used to pump the darts can be monitored at the surface. The graph in FIG. 11 shows the pressure or force, F, against distance travelled during latching and unlatching of the drive piston 406 as shown in FIGS. 7-10. The first increase in pressure detected at the surface indicates engagement of the drive piston 406 with the latching mechanism 636. The pressure will rise to a maximum as the latching portions pass over the first diameter surface 520. The pressure falls as the latching portions pass down into the recess 514, indicating that the piston has completed the first movement to eject the first plug 401. At this point, the ports 410 and 411 will be open and normal pumping can commence. The second dart 414 is pumped to release the second plug 402, and the pumping pressure will begin to rise when the second dart 414 engages the top of the first dart 413. The pressure plateaus again when the latching portions 636 pass over the second diameter surface 526. However, as the second diameter surface 526 has a larger diameter than the first diameter surface 520, a greater force will be needed to move the latching portions 636 back from the engaged position and release the drive piston 406, resulting in a higher pressure detected at the surface. Again, the pressure falls as the latching portions 636 pass down the surface 528, indicating the end of the movement that launches the second plug 402.

The use of spring dogs to latch the piston downhole components has advantages of easier maintenance, a smoother mechanism to unlatch the component, increased efficiency and reliability. Unlike the use of shear pins, there is no need to replace any parts after each use.

Various changes can be made within the scope of the invention. Where more than two plugs are to be launched, two or more recesses can be provided in the piston spaced along its surface, or two or more pistons can be used. The darts can be replaced by other release mechanisms such as balls. Other such changes will be apparent.

The invention claimed is:

1. An apparatus for use in launching cement plugs in a well cementing operation, comprising:

a cylinder having a bore and an inner wall;

a drive piston slideably received in the bore of the cylinder; and a main rod, operable by the piston, for launching a plug from the apparatus into the well;

wherein:

the apparatus is placed inside a tubular body;

the cylinder has a resiliently mounted latching member positioned along the inner wall and biased to project into the bore of the cylinder;

the drive piston has a profiled outer surface with angled surfaces defining a recess into which the latching member can project to hold the piston in a position in the cylinder;

the angled surfaces of the drive piston are arranged such that a first maximum force is required to move the piston such that the latching member passes over a first maximum diameter of the piston and engages in the recess, and a second maximum force is required to move the piston such that the latching member leaves the recess, passes over a second maximum diameter of the piston and completely releases the piston; and the second maximum diameter is larger than the first maximum diameter.

2. The apparatus as claimed in claim 1, wherein the angled surfaces allow the piston to engage the latching member to progressively move the member out of the bore of the cylinder, allowing the piston to move past the latching member.

3. The apparatus as claimed in claim 2, wherein first and second angled surfaces are on opposite sides of the recess.

4. The apparatus as claimed in claim 1, wherein multiple latching members are provided around the cylinder bore.

5. The apparatus as claimed in claim 1, wherein the latching member comprises spring dogs attached at one end to the cylinder and including a locking formation defined at the other, free end for engagement in the recess.

6. A method for launching a plug in a well cementing operation comprising:

(i) placing an apparatus inside a tubular body, the apparatus comprising:

a cylinder having a bore and an inner wall;

a drive piston slideably received in the bore of the cylinder; and a main rod, operable by the piston, for launching the plug from the apparatus into the well;

wherein:

the apparatus is placed inside the tubular body;

the cylinder has one or more resiliently mounted latching members positioned along the inner wall and biased to project into the bore of the cylinder;

the drive piston has a profiled outer surface with angled surfaces defining a recess into which the latching member can project to hold the piston in a position in the cylinder;

the angled surfaces of the drive piston are arranged such that a first maximum force is required to move the piston such that the latching member passes over a first maximum diameter of the piston and engages in the recess, and a second maximum force is required to move the piston such that the latching member leaves the recess, passes over a second maximum diameter of the piston and completely releases the piston, and the second maximum diameter is larger than the first diameter;

(ii) forcing the drive piston along the bore of the cylinder until the latching member engages in the recess;

(iii) forcing the drive piston further along the bore of the cylinder to remove the latching member from the recess; and (iv) measuring a first fluid pressure required to move the drive piston past the first maximum diameter and cause the latching member to engage in the recess, and a second fluid pressure required to cause the latching member to leave the recess, move past the second maximum diameter and cause the latching member to completely release the drive piston, wherein movement of the drive piston is transferred to the plug by means of the main rod.

7. The method as claimed in claim 6, wherein an increasing force, provided by the latching member, slows the movement of the drive piston before the latching member engages in the recess of the piston, bringing the piston to a hard stop.

8. The method as claimed in claim 6, wherein the step of forcing the drive piston along the bore of the cylinder comprises pumping a dart along a pipe connected to the cylinder until the dart contacts the drive piston, and applying fluid pressure above the dart to move the dart and drive piston along the cylinder bore.

9. The method as claimed in claim 6, wherein the step of forcing the drive piston along the cylinder bore comprises pumping a first dart into contact with the drive piston, and the step of subsequently forcing the drive piston along the cylinder bore comprises pumping a second dart into contact with the first dart.

10. The method as claimed in claim 9, further comprising measuring the pressure of the fluid used to move the darts and detecting a first pressure maximum indicative of engagement of movement of the latching member in the recess, and detecting a second maximum indicative of detachment of the latching member from the recess.

11. A method for separating fluids in a well comprising:

(i) pumping a first fluid;

(ii) placing an apparatus inside a tubular body, the apparatus comprising:

a cylinder having a bore and an inner wall;

a drive piston slideably received in the bore of the cylinder; and a main rod, operable by the piston, for launching a plug from the apparatus into the well;

wherein:

the apparatus is placed inside the tubular body;

the cylinder has a resiliently mounted latching member positioned along the inner wall and biased to project into the bore of the cylinder;

the drive piston has a profiled outer surface with angled surfaces defining a recess into which the latching member can project to hold the piston in a position in the cylinder;

the angled surfaces of the drive piston are arranged such that a first maximum force is required to move the piston such that the latching member passes over a first maximum diameter of the piston and engages in the recess, and a second maximum force is required to move the piston such that the latching member leaves the recess, passes over a second maximum diameter of the piston and completely releases the piston, and the second maximum diameter is larger than the first diameter;

(iii) forcing the drive piston along the bore of the cylinder until the latching member engages in the recess;

(iv) forcing the drive piston further along the bore of the cylinder to remove the latching member from the recess; wherein movement of the drive piston is transferred to the plug by means of the main rod;

(v) pumping a second fluid behind the plug, and (vi) measuring a first fluid pressure required to move the drive piston past the first maximum diameter and cause the latching member to engage in the recess, and a second fluid pressure required to cause the latching member to leave the recess, move past the second maximum diameter and cause the latching member to completely release the drive piston.

12. The method of claim 11, wherein multiple latching members are provided around the cylinder bore.

13. The method of claim 11, wherein the latching member comprises spring dogs attached at one end to the cylinder and including a locking formation defined at the other, free end for engagement in the recess.

14. The method of claim 11, wherein an increasing force, provided by the latching members, slows the movement of the drive piston down before the latching members engage in the recess of the drive piston, bringing it to a hard stop.

15. The method of claim 11, wherein the step of forcing the drive piston along the bore of the cylinder comprises pumping a dart along a pipe connected to the cylinder until the dart contacts the drive piston, and applying fluid pressure above the dart to move the dart and drive piston along the cylinder bore.

* * * * *